United States Patent [19]

Goodrich

[11] 4,423,399

[45] Dec. 27, 1983

[54] ELECTROMAGNETIC CONTACTOR

[75] Inventor: Ronald W. Goodrich, Logansport, Ind.

[73] Assignee: Essex Group, Inc., Fort Wayne, Ind.

[21] Appl. No.: 371,107

[22] Filed: Apr. 23, 1982

[51] Int. Cl.[3] ..... H01H 45/04

[52] U.S. Cl. ..... 335/202; 335/135; 336/192

[58] Field of Search ..... 335/202, 135, 193, 121, 335/128; 336/192; 339/200

[56] References Cited

U.S. PATENT DOCUMENTS

| | | | |
|---|---|---|---|
| 3,014,103 | 12/1961 | Moran et al. | 335/193 |
| 3,014,164 | 12/1961 | Howenstine | 336/192 |
| 3,117,294 | 1/1964 | Muszynski et al. | 336/192 |
| 3,209,095 | 9/1965 | Obszarny | 335/121 |
| 3,243,546 | 7/1966 | Woods | 335/193 |
| 3,359,395 | 12/1951 | Bruce | 200/237 |
| 4,199,740 | 4/1980 | Woods | 335/202 |
| 4,347,493 | 8/1982 | Adams et al. | 336/192 |

*Primary Examiner*—Harold Broome

*Attorney, Agent, or Firm*—Robert D. Sommer

[57] ABSTRACT

An electromagnetic contactor comprising a terminal and contact block supported at one end on a magnetic frame includes cooperating interlocking means on its coil bobbin and the block for rigidly supporting the block at an additional location. The interlocking means on the coil bobbin include a pair of oppositely directed support arms with upstanding projections in mating engagement with wall members of the block. Each support arm also has a recess that receives a sheet metal coil terminal with lugs that are bent into contact with the arm after insertion of the terminal into the recess to prevent movement of the coil terminal with respect to the arm.

6 Claims, 7 Drawing Figures

FIG. 1
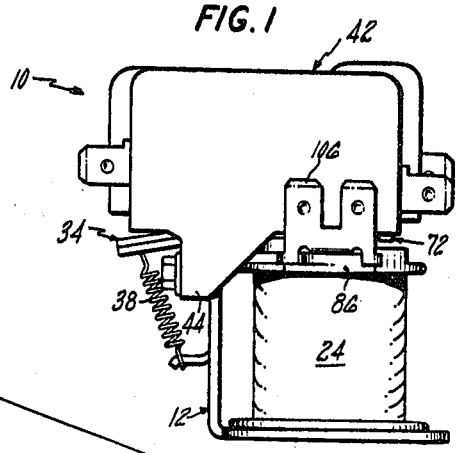
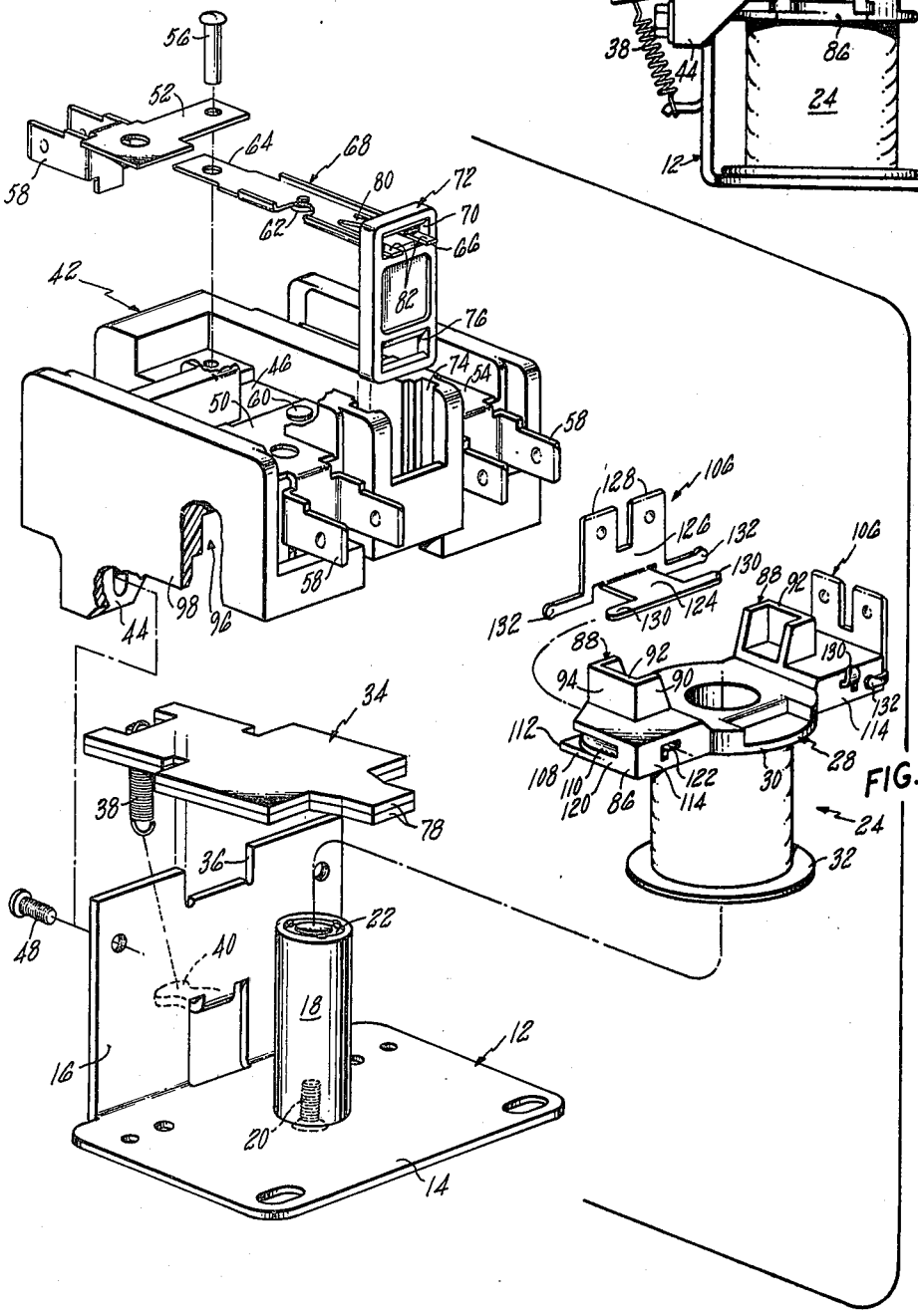
FIG. 2

FIG. 3
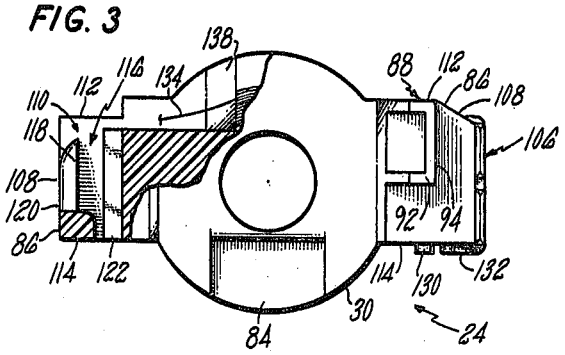
FIG. 4
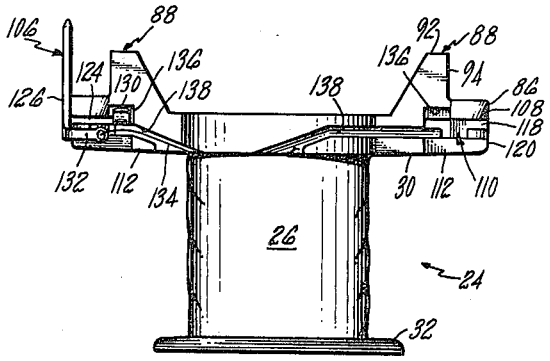
FIG. 7
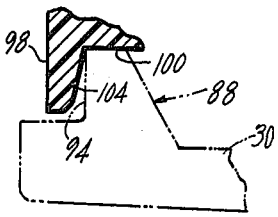
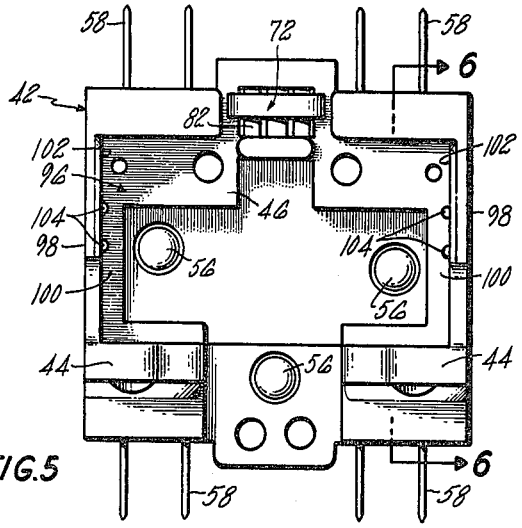
FIG.5
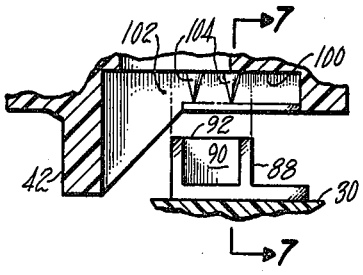
FIG. 6

ELECTROMAGNETIC CONTACTOR

BACKGROUND OF THE INVENTION

This invention relates to electromagnetic contactors and more particularly to small, low cost electromagnetic contactors of the type used in air conditioning and heating systems.

Small low cost electromagnetic contactors of the type disclosed in the Moran et al U.S. Pat. No. 3,014,103 issued Dec. 19, 1961, and the Woods U.S. Pat. No. 3,243,546 issued Mar. 29, 1966, and the Woods U.S. Pat. No. 4,199,740 issued Apr. 22, 1980 are commonly employed in air conditioning and heating systems. In such contactors, the switch terminal and contact structure is carried by a terminal and contact block mounted in cantilever fashion on one leg of a L-shaped magnetic frame. Because the blocks of such contactors are supported at only one location, they have sometimes been deflected or damaged in use, especially when external connectors are attached to the switch terminal and contact structure.

In contactors such as those disclosed in the above cited patents, the coil terminals extend radially of the coil assembly between the ends thereof at positions remote from the switch and contact structure and are not readily accessible from the top of the contactor where the switch terminals are disposed. Applying and removing the external coil connectors therefore may be cumbersome or difficult when such contactors are installed in air conditioning and heating systems. Furthermore, the connections between the coil terminals and the coil are sometimes damaged when the external connectors are improperly applied or removed.

In the Obszarny U.S. Pat. No. 3,209,095 issued Sept. 28, 1965, there is disclosed a somewhat similar type of contactor with the coil terminals disposed in recessed arms extending outwardly from one end flange of a coil bobbin. A pair of posts on the terminal and contact block of this contactor supports the bobbin arms and are hollow to receive screws for making electrical connections to the coil terminals from the opposite side of the block. Although the coil terminals are supported to prevent their being damaged and are accessible from either side of the block for screw connections to external connectors, this arrangement is somewhat cumbersome in use.

The Bruce U.S. Pat. No. 3,359,395 issued Dec. 19, 1967 discloses another arrangement for attaching coil terminals to the flange of bobbin. Terminals provided with a pair of lugs are inserted in cross-shaped recesses with the lugs extending through suitable openings and bent toward one another to secure the terminals from movement. This particular terminal arrangement is adapted to a reed relay intended for use with a printed circuit board and is not especially suited for use with the coil assembly of an electromagnetic contactor.

SUMMARY OF THE INVENTION

The present invention overcomes these and other disadvantages of the prior art contactors by providing an electromagnetic contactor in which the terminal and contact block is rigidly supported and the coil terminals are securely fixed in place adjacent the block.

An electromagnetic contactor in one form of the invention includes an electromagnet comprising a L-shaped frame having a base portion and a leg portion, a coil assembly having end flanges and a coil wound about the bobbin between the flanges, a core secured at one end to the base portion of the frame, and an armature pivotally mounted on the leg portion of the frame for movement toward and away from the other end of the core. A block of insulating material has foot portions secured directly to the leg portion of the frame and has platform portion disposed substantially at right angles to the foot portions to extend over the armature and coil assembly. A contact spring is mounted cantilever fashion on the block and carries a movable contact for engagement with another contact mounted on the block. An actuator operable by the armature engages the contact spring for flexing the contact spring toward the other contact. The bobbin and the block are provided with cooperating interlocking means for rigidly supporting the platform portion of the block relative to the frame at a location spaced from the foot portions.

More specifically, a pair of oppositely directed integral support arms extend outwardly beyond opposite sides of the armature from the bobbin flange facing the armature and the platform portion. The platform portion includes two spaced apart wall members projecting from respective ledge surfaces toward the support arms and defining a chamber therebetween. An upstanding projection integrally formed on each support arm projects into the chamber into mating engagement with a corresponding one of the wall members and a respective ledge surface. Locking means on the wall members provide frictional engagement with the projections when the platform portion is forcibly urged over the projections to bring the projections into mating engagement with the wall members.

In a preferred embodiment of the invention, the ledge surfaces are generally coplanar and the wall members extend generally perpendicularly to the ledge surfaces in generally parallel relation. The opposed surfaces of the wall members are each generally planar and each has a pair of locking ribs formed thereon to provide the aforesaid locking means. Each of the locking ribs is sloped to form a cam surface. In addition, each of the projections on the support arms may include a generally rectangularly shaped, planar upstanding section forming an outer locking surface generally parallel to the opposed surfaces of the wall members of sufficient width to bear against a corresponding pair of the locking ribs. Each projection also may include an upper abutment surface of sufficient width to bear against a corresponding one of the ledge surfaces.

Also according to a particular embodiment of one aspect of the invention, each support arm of the bobbin supports a sheet metal terminal connected to a conductor extending from the coil. Each support arm has an outer end and two opposed side walls and further has generally L-shaped recess formed therein. The recess has a continuous insertion opening which includes a first open portion in one of the opposed side walls and a second open portion in the outer end. The recess further has a relatively narrow slot portion open through the other of the opposed side walls. The terminal has an anchoring portion snugly fitting with the recess and also has a blade contact portion disposed at substantially right angles to the anchoring portion to overlie the outer end of the arm. The anchoring portion of the terminal is receivable laterally edgewise in the recess through the insertion opening and has first and second lugs extending respectively therefrom through the first open portion and the slot portion of the recess.

These lugs are bent into contact with the respective support arm to tightly clamp the terminal to the arm. The one opposed side wall of the support arm has a groove formed therein receiving the bent end of the first lug.

In accordance with this particular embodiment of the invention each terminal may include a terminal tab extending from the blade contact portion and electrically connected to a conductor extending from the coil. This terminal tab may be bent to overlie one of the opposed side walls of the respective supporting arm. In addition, the bobbin flange may have a channel formed in a peripheral edge portion thereof which communicates with the first open portion of the recess. The coil conductor connected to the terminal tab may be positioned in this channel and the first open portion of the recess.

For a better understanding of the invention, reference may be had to the following detailed description taken in connection with the accompanying drawings, in which:

BRIEF DESCRIPTION OF THE DRAWINGS

FIG. 1 is a side view of an electromagnetic contactor according to the present invention;

FIG. 2 is an exploded perspective view of the electromagnetic contactor of FIG. 1;

FIG. 3 is a top view, partially broken away and partially in section, of the coil assembly shown in FIG. 2;

FIG. 4 is a rear view of the coil assembly shown in FIG. 2;

FIG. 5 is a bottom view of the terminal and contact block shown in FIG. 2;

FIG. 6 is a fragmentary sectional view taken along the line 6—6 of FIG. 5 and illustrating the mating relating between the terminal and contact block and an upstanding projection of the bobbin; and FIG. 7 is a sectional view taken along the line 7—7 of FIG. 6.

DESCRIPTION OF THE PREFERRED EMBODIMENT

Referring now to the drawings, an electromagnetic contactor 10 in accordance with the present invention includes a frame 12 formed from a ferromagnetic material and having a base portion 14 and a leg portion 16 bent at right angles to each other. A cylindrical core 18 of ferromagnetic material is secured to one end to the frame base portion 14 by conventional means such as a screw 20 and may have a conventional shading ring 22 embedded in its other end. The core 18 carries a coil assembly 24 which includes an electrical coil 26 wound about a bobbin 28 molded of nylon or other suitable insulation material between the end flanges 30 and 32 of the bobbin. A laminated armature 34 extending through an opening 36 provided in the frame leg portion 16 is pivotally supported thereon in a conventional manner for movement toward and away from the core 18. The armature 34 is normally biased away from the core 18 by a tension spring 38 connected between one end of the armature and a lug 40 lanced out of the frame leg portion 16.

A terminal and contact block 42 molded of a phenolic resin or other suitable insulation material is mounted on the frame leg portion 16. The block 42 has two foot portions 44 extending at substantially right angles from a platform portion 46 and secured directly to the frame leg portion 16 by the screws 48. Three terminal members 50, 52 and 54 are secured to the upper face of the block platform portion 46 by suitable means such as the rivets 56 and may be provided with tabs 58 or other appropriate means to which electrical connections may be made.

A stationary contact 60 is mounted on the terminal member 50 for engagement by a movable contact 62 that is carried intermediate the ends 64 and 66 of a contact spring 68 which is formed of spring metal. The contact spring 68 is mounted in cantilever fashion on the platform portion 46 with one end 64 welded to the lower side of the terminal member 52 and the other end 66 protruding through a window 70 formed in an actuator 72. The actuator 72 is slidably mounted in a slot-like opening 74 extending through the platform portion 46 and has an aperture 76 in its lower end which receives the tongues 78 at one end of the armature 34. At its end 66, the contact spring 68 is longitudinally lanced to provide an upwardly bent finger portion 80 intermediate two outer finger portions 82 which are all in driven engagement with the actuator 72. Upon attraction of the armature 34 toward the core 18, the resulting movement of the actuator 72 will flex the contact spring 68 toward the contact 60 to effect engagement of the contacts 60 and 62. The upper face of the bobbin flange 30 may be recessed at 84 to accommodate the lower end of the actuator 72 when the armature 34 is in attracted relation to the core 18.

In accordance with one aspect of the present invention, the bobbin 28 and the block 42 are provided with cooperating interlocking means for rigidly supporting the platform portion 46 relative to the frame 12 at an additional location away from the supported end at the foot portions 44. For this purpose, the bobbin flange 30 has formed integrally therewith a pair of oppositely directed, outwardly extending support arms 86. A substantially U-shaped upstanding projection 88 integrally formed on each arm 86 is directed toward the platform portion 46 along a respective side of the armature 34. Each projection 88 includes generally rectangularly shaped, planar upstanding section 90 with an upper abutment surface 92 and an outer locking surface 94.

A chamber 96 to receive the projections 88 is formed in the lower side of the platform portion 46 between a pair of side walls 98 which project from respective ledge surfaces 100 toward the support arms 86. The ledge surfaces 100 are generally coplanar and the opposed inner surfaces 102 of the side walls 98 extend generally perpendicularly to the ledge surfaces 100 in generally parallel relation. The upstanding sections 90 of the projections 88 are also in generally parallel relation with their respective outer locking surfaces 94 spaced for mating engagement with the opposed surfaces 102 of the side walls 98. To provide frictional engagement of the projections 88 with the side walls 98, a pair of locking ribs 104 are formed on each of the side wall surfaces 102. These ribs 104 are each preferably tapered or sloped at an angle of about 7° to form a cam surface which facilitates the forcibly urging of the platform portion 46 over the projections 88.

In accordance with another aspect of the present invention, the support arms 86 also may be employed in a terminal arrangement for the coil assembly 24 which includes a pair of terminals 106. For this purpose, an outermost end portion 108 of each support arm 86 is formed with a generally L-shaped transverse recess 110 therein extending between the opposed side walls 112 and 114 of the arm 86. Each recess 110 has a continuous insertion opening which includes a first open portion 116 opening in the wall 112 and a second open portion 118 opening in the outer end 120 of the respective arms 86. Each recess 110 further has a relatively narrow slot portion 122 opening in the wall 114.

Each recess 110 is arranged to receive the anchoring portion 124 of a terminal 106 which snugly fits within the recess 110. Each terminal 106 is formed from a unitary strip of sheet metal to have a flat blade contact protion 126 which extends substantially at right angles to the anchoring portion 124 and preferably has two blade contacts 128 to which electrical connections may be made with conventional receptacle terminals (not shown). Along its side edges, the anchoring portion 124 is provided with respective lugs 130, both of which are preferably sized to be snugly received in the slot portion 122 of the recess 110. The blade contact portion 126 of each terminal 106 is provided with a pair of outwardly extending terminal tabs 132 to either of which may be soldered or otherwise electrically connected a conductor 134 extending from the coil 26.

To attach one of the terminals 106 to an arm 86 of the bobbin 28, the anchoring portion 124 of the terminal is inserted laterally edgewise into the recess 110 through the open portion 116 of the insertion opening with one lug 130 entering the slot portion 122 of the recess. After the anchoring portion 124 is inserted into the recess 110 to a position where the lugs 130 project from opposite side walls 112 and 114 of the support arm 86, the ends of the lugs 130 are bent into contact with the arm 86 to tightly clamp the terminal 106 to the arm. To ensure retention of the terminal 106, the side wall 112 has a groove 136 formed therein to receive the end of the lug 130 bent against the side wall 112. In the inserted position of a terminal 106 in an arm 86, its blade contact portion 126 overlies the outer end 122 of the arm with the blade contacts 128 projecting upwardly from the arm. It will be apparent that each terminal 106 will remain securely fixed to its respective support arm 86 when receptable terminals are applied to and removed from the blade contacts 128.

The bobbin flange 30 has two channels or guide slots 138 formed in a peripheral edge portion thereof which communicate with respective open portions 116 of the recesses 110. The two conductors 134 extending from the coil 26 are guided outwardly through these channels 138 to respective terminal tabs 132 of the terminals 106. After the conductors 134 are electrically connected to these terminal tabs 132, the latter may be bent to overlie the respective walls 112 of the arms 86 at the open portions 116 of the recesses 110.

In assembly of the contactor 10, the actuator 72 is inserted in the opening 74 of the block 42 and the contact spring 68 and the terminals 50, 52, 54 together with the contacts 60 and 62 are secured to the block 42 to provide a block subassembly. In addition, the core 18 is secured to the frame 12 to provide a frame subassembly. After the coil assembly 24 is placed upon the frame subassembly with the core 18 extending through the bobbin 28, the tongues 78 of the armature 34 are inserted into the aperture 76 of the actuator 72 and the block subassembly together with the armature 34 are positioned on the bobbin assembly and the frame subassembly. This seats the armature 34 in the opening 36 of the frame leg portion 16 and brings the side walls 98 of the block 42 into mating engagement with the projections 88 on the bobbin 28. As the block 42 is forcibly urged over the projections 88 to a position where the abutment surfaces 92 of the projections 88 bear against the ledge surfaces 100 of the block 42, the locking ribs 104 on the opposed surfaces 102 of the block 42 frictionally bear against the outer locking surfaces 94 of the projections 88. With the block in this position, the screws 48 are inserted through suitable elongated openings in the foot portions 44 of the block to secure the block 42 to the frame leg portion 16. The frame 12 and the block 42 preferably should be held in a suitable fixture while being secured together by the screws 48 to ensure their proper positioning.

From the foregoing, it will be seen that the platform portion 46 of the block 42 is supported not only at one end by the foot portions 44 but also intermediate it ends by the projections 88 on the support arms 86. Consequently the block 42 is quite rigidly supported and is not likely to be deflected or damaged when external connectors are applied to or removed from the terminal members 50, 52 and 54 with undue force. Furthermore, the blade contact protions 126 of the coil terminals 106 are located at the respective sides of the block 42 adjacent its upper surface for ready access thereto for applying or removing external connectors. In addition, the coil terminals 106 are held in secure assembly with the coil bobbin 28 to prevent damage to the connections between the coil 26 and the coil terminals when external connectors are improperly applied or removed. In addition to these advantages, the electromagnetic contactor embodying the present invention can be manufactured with substantially the same small size and low cost of conventional contactors.

While there has been described above the principles of this invention in connection with a specific contactor construction, it is to be understood that this description is made only by way of example and not as limitation to the scope of the invention.

What is claimed is:

1. In an electromagnetic contactor of the type comprising an L-shaped frame having a base portion and a leg portion, a coil assembly comprising a bobbin having end flanges and a coil wound about said bobbin between said flanges, a core secured at one end to said base portion and carrying said coil assembly, an armature pivotally mounted on said leg portion for movement toward and away from the other end of said core, a block of insulating material having foot portions secured directly to said leg portion and having a platform portion disposed substantially at right angles to said foot portions to extend over said armature and said coil assembly, a contact spring mounted cantilever fashion on said block and carrying a movable contact, another contact mounted on said block for engagement by said movable contact, and an actuator engaging said contact spring and operable by said armature for flexing said contact spring toward said other contact; cooperating interlocking means on said bobbin and said block for rigidly supporting said platform portion relative to said frame at a location spaced from said foot portions which comprise: a pair of oppositely directed integral support arms extending outwardly beyond opposite sides of said armature and said platform portion; said platform portion including two spaced apart wall members projecting from respective ledge surfaces toward said arms and defining a chamber therebetween; an upstanding projection integrally formed on each of said arms and projecting into said chamber for mating engagement with a corresponding one of said wall members and a respective ledge surface; and locking means on said wall members for providing frictional engagement with said projections when said platform portion is forcibly urged over said projections to bring said projections into mating engagement with said wall members.

2. The electromagnetic contactor of claim 1 wherein said ledge surfaces are generally coplanar and said wall members extend generally perpendicularly to said ledge surfaces in generally parallel relation; the opposed surfaces of said wall members each being generally planar and having a pair of locking ribs formed thereon to define said locking means; each of said ribs being sloped to form a cam surface.

3. The electromagnetic contactor of claim 2 wherein each of said projections includes a generally rectangularly shaped, planar upstanding section forming an outer locking surface generally parallel to said opposed surfaces of said wall members of sufficient width to bear against a corresponding pair of said ribs and an upper abutment surface of sufficient width to bear against a corresponding one of said ledge surfaces.

4. In a coil assembly having an electrical coil wound on a bobbin which has a flange on at least one end thereof and wherein said flange supports at least one terminal connected to a conductor extending from said coil; the improvement comprising: at least one integral terminal support arm extending outwardly from said flange and having an outer end and two opposed side walls; said one arm having a generally L-shaped recess formed therein; said recess having a continuous insertion opening including a first open portion in one of said opposed walls and second open portion in said outer end; said recess further having a relatively narrow slot portion open through the other of said opposed walls; a sheet metal terminal having an anchoring portion snugly fitting within said recess and a blade contact portion disposed at substantially right angles to said anchoring portion to overlie said outer end of said arm; said anchoring portion being receivable laterally edgewise in said recess through said insertion opening; first and second lugs extending respectively from said anchoring portion through said first open portion and said slot portion of said recess; said first and second lugs being bent into contact with said arm to tightly clamp said terminal to said arm; said one opposed wall of said arm having a groove formed therein receiving the bent end of said first lug.

5. The coil assembly of claim 4 wherein said terminal includes a terminal tab extending from said blade contact portion and electrically connected to a conductor extending from said coil; said terminal tab being bent to overlie said one opposed wall.

6. The coil assembly of claim 5 wherein said flange has a peripheral edge portion with a channel formed therein which communicates with said first open portion of said recess; said conductor being positioned in said channel and said first open portion.

* * * * *